US005427656A

United States Patent [19]

Behr et al.

[11] Patent Number: 5,427,656

[45] Date of Patent: Jun. 27, 1995

[54] PROCESS FOR PREPARING BRANCHED PERFLUOROCHEMICALS

[75] Inventors: Fredrick E. Behr; Yuri Cheburkov, both of Woodbury; John C. Hansen, Lakeland; Dong-Wei Zhu, Woodbury, all of Minn.

[73] Assignee: Minnesota Mining and Manufacturing Company, Saint Paul, Minn.

[21] Appl. No.: 219,119

[22] Filed: Mar. 29, 1994

[51] Int. Cl.[6] ..... C25B 3/08

[52] U.S. Cl. ..... 204/59 F; 204/81

[58] Field of Search ..... 204/59 R, 59 F, 72, 204/81

[56] References Cited

U.S. PATENT DOCUMENTS

| | | | |
|---|---|---|---|
| 2,519,983 | 8/1950 | Simons | 204/62 |
| 3,668,233 | 6/1972 | Pavlik | 260/471 C |
| 3,950,235 | 4/1976 | Benninger | 204/59 F |
| 3,962,348 | 6/1976 | Benninger et al. | 260/615 F |
| 4,173,654 | 11/1979 | Scherer | 424/350 |

FOREIGN PATENT DOCUMENTS

| | | | |
|---|---|---|---|
| 55-035020 | 11/1980 | Japan | C07C 69/63 |
| 879057 | 10/1961 | United Kingdom . | |

OTHER PUBLICATIONS

T. Ono et al., J. Fluorine Chem. 27, 333 (1985), (no month).

M. Napoli et al., J. Fluorine Chem. 45, 213 (1989), (no month).

R. D. Chambers et al., J. Fluorine Chem. 49, 409 (1990), (no month).

Abe, T. et al., *Preparation, Properties, and Industrial Applications of Organofluorine Compounds,* edited by R. E. Banks, John Wiley & Sons, p. 25, New York (1982).

Burdon, J. and J. C. Tatlow, *Advances in Fluorine Chemistry* (M. Stacey, J. C. Tatlow, and A. G. Sharpe, editors), vol. 1, pp. 129–137, Butterworths Scientific Publications, London (1960), (no month).

Childs, W. V., L. Christensen, F. W. Klink, and C. F. Kolpin, *Organic Electrochemistry* (H. Lund and M. M. Baizer, editors), Third Edition, pp. 1103–1112, Marcel Dekker, Inc., New York (1991), (no month).

Costa, G. et al., J. Macromol. Sci.-Chem., A18(2), 299 (1982), (no month).

Dmowski, W., J. Fluorine Chem. 49, 281 (1990), (no month).

Dmowski, W. et al., J. Fluorine Chem. 36, 385 (1987), (no month).

*Encyclopedia of Chemical Technology,* Kirk-Othmer, Third Edition, vol. 10, pp. 835–836, John Wiley & Sons (1980), (no month).

England, D. C., et al., J. Fluorine Chem. 17, 265 (1981), (no month).

*Fluorine Chemistry,* edited by J. H. Simons, vol. 1, Academic Press, Inc., pp. 416–418, New York (1950), (no month).

Huang, H. et al., J. Chem. Soc. Perkin Trans. 1 1991, 871. (no month).

(List continue on next page.)

*Primary Examiner*—John Niebling

*Assistant Examiner*—Edna Wong

*Attorney, Agent, or Firm*—Gary L. Griswold; Walter N. Kirn; Lucy C. Weiss

[57] ABSTRACT

A process for preparing inert or functional, tertiary carbon-containing perfluorochemicals comprises the step of electrochemically fluorinating, in the presence of anhydrous hydrogen fluoride, a composition comprising at least one starting compound selected from the group consisting of those fluoroalkanes, fluoroalkenes, fluoroalcohols, fluorocarboxylic acids, fluorocarboxylic acid halides, fluorocarboxylic acid esters, and combinations thereof which contain at least one (preferably, only one) $—CX_2—C(R_f)_2—$ group, wherein each X is independently selected from the group consisting of hydrogen, fluorine, and $CH_2OH$, with the proviso that only one X can be $CH_2OH$, and each $R_f$ group is independently perfluoroalkyl. The process enables preservation of the highly-branched structure of the starting compounds resulting in high product yields.

11 Claims, No Drawings

OTHER PUBLICATIONS

Ishikawa, N. et al., Nippon Kagaku Kaishi 1974(7), 1240. (no month).

Knunyants, I. L. et al., Izv. Akad. Nauk SSSR, Ser. Khim. (English translation) Jan. 1971(1), 93.

LaZerte, J. D. et al., J. Am. Chem. Soc. 77, 910 (Feb. 1955).

March, J., *Advanced Organic Chemistry,* Third Edition, John Wiley & Sons, pp. 141–151, New York (1985), (no month).

Olah, G. A., *Friedel–Crafts and Related Reactions,* vol. II, Part 1, Interscience Publishers, pp. 41–45, New York (1964), (no month).

Rozhkov, I., *Organic Electrochemistry,* edited by H. Lund and M. M. Baizer, Second Edition, Marcel Dekker, Inc., p. 815, New York (1983), (no month).

Rudge, A. J., *Industrial Electrochemical Process* (A. T. Kuhn, editor), pp. 71–75, Marcel Dekker, Inc., New York (1967), (no month).

*Syntheses of Fluoroorganic Compounds,* edited by I. L. Knunyants et al., Springer–Verlag, p. 9, New York (1985), (no month).

Wiley et al. Kirk–Othmer Encyclopedia of Chemical Technology, 3rd ed., vol. 10, (1980) [no month] pp. 834–836.

D. D. Moldavsky et al., J. Fluorine Chem. 63, 193, (1993), (no month).

J. Burdon et al., J. Chem. Soc., Perkin Trans. 2, 1991, 445, (no month).

G. G. I. Moore et al., J. Fluorine Chem. 32, 41 (1986), (no month).

G. P. Gambaretto et al., J. Fluorine Chem. 27, 149 (1985), (no month).

PROCESS FOR PREPARING BRANCHED PERFLUOROCHEMICALS

FIELD OF THE INVENTION

This invention relates to a process for preparing inert or functional, tertiary carbon-containing perfluorochemicals.

BACKGROUND OF THE INVENTION

Fluorochemical compounds and their derivatives (sometimes called organofluorine compounds or fluorochemicals) are a class of substances which contain portions that are fluoroaliphatic or fluorocarbon in nature, e.g., nonpolar, hydrophobic, oleophobic, and chemically inert, and which may further contain portions which are functional in nature, e.g., polar and chemically reactive. The class includes some commercial substances which are familiar to the general public, such as those which give oil and water repellency and stain and soil resistance to textiles, e.g., Scotchgard TM carpet protector.

An industrial method of producing many fluorinated compounds, such as perfluorinated and partially-fluorinated organofluorine compounds, is the electrochemical fluorination process, commercialized initially in the 1950s by 3M Company, which comprises passing an electric current through a mixture of the organic starting compound and liquid anhydrous hydrogen fluoride. This fluorination process is commonly referred to as the "Simons electrochemical fluorination process," or more simply either the Simons process or electrochemical fluorination (ECF). The Simons ECF process is disclosed in U.S. Pat. No. 2,519,983 (Simons) and is also described in some detail by J. Burdon and J. C. Tatlow in *Advances in Fluorine Chemistry* (M. Stacey, J. C. Tatlow, and A. G. Sharpe, editors), Volume 1, pages 129–37, Butterworths Scientific Publications, London (1960), by W. V. Childs, L. Christensen, F. W. Klink, and C. F. Kolpin in *Organic Electrochemistry* (H. Lund and M. M. Baizer, editors), Third Edition, pages 1103–12, Marcel Dekker, Inc., New York (1991), and by A. J. Rudge in *Industrial Electrochemical Processes* (A. T. Kuhn, editor), pages 71–75, Marcel Dekker, Inc., New York (1967).

Simons ECF can be utilized to prepare fluorinated compounds such as fluorinated carboxylic acid fluorides and fluorinated alkanes. However, a drawback of the process is that side reactions often occur. Such side reactions involve cleavage of carbon-carbon bonds and polymer formation. (See *Encylopedia of Chemical Technology,* Kirk-Othmer, Third Edition, Volume 10, pages 835–36, John Wiley & Sons (1980).) For example, when fluorinated carboxylic acid fluorides are prepared by ECF, low purity and low yields are often obtained due to the formation of rearrangement and cleavage products. Both T. Abe et al. (in *Preparation, Properties, and Industrial Applications of Organofluorine Compounds,* edited by R. E. Banks, John Wiley & Sons, page 25, New York (1982)) and I. Rozhkov (in *Organic Electrochemistry,* edited by H. Lund and M. M. Baizer, Second Edition, Marcel Dekker, Inc., page 815, New York (1983)) report low retention in ECF of branched structures. Tertiary structures in particular may be difficult to maintain, as it is known that such structures undergo rearrangement in strongly acidic environments such as hydrogen fluoride (see, e.g., the discussion by G. A. Olah in *Friedel-Crafts and Related Reactions,* Volume II, Part 1, Interscience Publishers, pages 41–45, New York (1964) and by J. March in *Advanced Organic Chemistry,* Third Edition, John Wiley & Sons, pages 141–151, New York (1985)).

Although direct fluorination processes (which employ fluorine gas as the fluorinating agent) can be utilized to minimize cleavage problems and enable the preparation of tertiary carbon-containing fluorochemicals, such processes are more costly than Simons ECF (due to the expense of fluorine manufacture and due to poor fluorine efficiency), more hazardous than Simons ECF (due to the risks associated with the use of the highly reactive fluorine gas), and may yield incompletely-fluorinated product (see, e.g., the Dmowski reference infra). It is therefore highly desirable that modifications of the Simons ECF process be developed which reduce or eliminate the cleavage problems associated with it and which thereby enable the preparation of even tertiary carbon-containing perfluorochemicals by Simons ECF.

U.S. Pat. No. 3,950,235 (Benninger) discloses a method for preparing branched perfluoroalkanes by the electrochemical fluorination of branched perfluoroolefins.

H. Huang et al. (J. Chem. Soc. Perkin Trans. 1 1991, 871) describe the preparation of branched perfluorinated ethers and branched perfluoroalkanoyl fluorides by the direct fluorination of alkanols.

D. C. England et al. (J. Fluorine Chem. 17, 265 (1981)) disclose the preparation of heptafluoro-2,2-bis(-trifluoromethyl)pentanoyl fluoride by the reaction of carbonyl fluoride with hexafluoropropene dimer in the presence of silver oxide.

W. Dmowski (J. Fluorine Chem. 49, 281 (1990)) describes the direct fluorination of branched fluorohydrocarbons to provide incompletely-fluorinated products.

SUMMARY OF THE INVENTION

Briefly, this invention provides a process for preparing inert or functional, tertiary carbon-containing perfluorochemicals, namely, tertiary carbon-containing perfluorinated alkanes and tertiary carbon-containing perfluorinated carboxylic acid fluorides. The process comprises the step of electrochemically fluorinating, in the presence of anhydrous hydrogen fluoride, a composition comprising at least one starting compound selected from the group consisting of those fluoroalkanes, fluoroalkenes, fluoroalcohols, fluorocarboxylic acids, fluorocarboxylic acid halides, fluorocarboxylic acid esters, and combinations thereof which contain at least one (preferably, only one) $—CX_2—C(R_f)_2—$ group, wherein each X is independently selected from the group consisting of hydrogen, fluorine, and $CH_2OH$, with the proviso that only one X can be $CH_2OH$, and each $R_f$ group is independently perfluoroalkyl.

The process of the invention enables preservation of the highly-branched structure of the starting compounds and thus makes possible the preparation of high yields of perfluoroalkanes and perfluorocarboxylic acid fluorides having a tertiary carbon-containing structure heretofore difficult to obtain in significant yields by most electrochemical fluorination routes. Furthermore, since the process involves electrochemical fluorination, it is both less expensive and less hazardous than direct fluorination processes.

DETAILED DESCRIPTION OF THE INVENTION

Starting compounds which can be utilized in the process of the invention are those fluoroalkanes, fluoroalkenes, fluoroalcohols, fluorocarboxylic acids, fluorocarboxylic acid halides, fluorocarboxylic acid esters, and combinations thereof which contain at least one (preferably, only one) $—CX_2—C(R_f)_2—$ group, wherein each X is independently selected from the group consisting of hydrogen, fluorine, and $CH_2OH$, with the proviso that only one X can be $CH_2OH$, and each $R_f$ group is independently perfluoroalkyl. A class of such starting compounds is that which can be represented by the general formula I:

$$R^1—C(R_f^2)(R_f^3)—(CH_2)_n—X' \quad (I)$$

wherein $R^1$ is selected from the group consisting of perfluoroalkyl groups having from 1 to about 11 carbon atoms, fluoroalkyl groups having from 1 to about 11 carbon atoms, alkyl groups having from 1 to about 3 carbon atoms, alkenyl groups having from 3 to about 6 carbon atoms, and $R_f'CF(CH_2OH)$, wherein $R_f'$ is selected from the group consisting of perfluoroalkyl groups having from 1 to about 5 carbon atoms and fluoroalkyl groups having from 1 to about 5 carbon atoms; $R_f^2$ and $R_f^3$ are independently selected from the group consisting of perfluoroalkyl groups having from 1 to about 11 carbon atoms; n is an integer of 0 to 3; and X' is selected from the group consisting of hydrogen, fluorine, COY, vinyl, and COOR, wherein Y is selected from the group consisting of the halogens and OH, and R is an alkyl group having from 1 to about 6 carbon atoms, with the proviso that when $R^1$ is alkyl, n is 0 and X' is COY, and that when $R^1$ is $R_f'CF(CH_2OH)$, X' cannot be COY. Compositions which can be fluorinated according to the process of the invention comprise, consist, or consist essentially of one or more such compounds. Other fluorinatable or non-fluorinatable compounds can also be present in the compositions in addition to starting compound. Preferably, $R^1$ is selected from the group consisting of methyl, ethyl, allyl, perfluoropropyl, $CF_3CF_2CF(CH_2OH)$, and $CF_3CFHCF(CH_2OH)$; $R_f^2$ and $R_f^3$ are both perfluoromethyl; and X' is selected from the group consisting of hydrogen, COF, vinyl, $COOCH_3$, and $COOCH_2CH_3$, as the starting compounds thereby defined can be easily prepared.

Representative examples of starting compounds suitable for use in the process of the invention include $C_3F_7C(CF_3)_2CH_3$, $C_3F_7C(CF_3)_2CH_2CH_3$, $C_3F_7C(CF_3)CH_2CH_2CH_3$, $C_3F_7C(CF_3)_2CH_2CH{=}CH_2$, $C_3F_7C(CF_3)_2CH_2COOCH_3$, $C_3F_7C(CF_3)_2CH_2COOCH_2CH_3$, $CH_3C(CF_3)_2COF$, $CH_3CH_2C(CF_3)_2COF$, $CH_2{=}CHCH_2C(CF_3)_2COF$, $C_2F_5CF(CH_2OH)C(CF_3)_2H$, and $(CF_3)_2CFCF(CH_2OH)CHF(CF_3)$.

Starting compounds of formula I above, where $R^1$ is perfluoroalkyl or fluoroalkyl and X' is hydrogen or vinyl, can be prepared by the reaction of perfluoroalkenes with alkyl halides in aprotic solvent, as described for perfluoro-4-methyl-2-pentene by W. Dmowski et al. in J. Fluorine Chem. 36, 385 (1987). Starting compounds of formula I above, where $R^1$ is perfluoroalkyl or fluoroalkyl and X' is hydrogen or COOR, can be prepared by the addition of fluoride ion to a perfluoroolefin to form an intermediate tertiary fluorocarbanion followed by alkylation of the carbanion, as described in U.S. Pat. No. 4,173,654 (Scherer), the description of which is incorporated herein by reference.

Starting compounds of formula I above, where $R^1$ is perfluoroalkyl or fluoroalkyl and X' is COOR, can be prepared by the reaction of perfluoroalkenes with either haloformates, e.g., methyl chloroformate, or α-haloacetates, e.g., methyl chloroacetate, as described, e.g., in JP 55-035020 (Neos Co., Ltd.).

Starting compounds of formula I above, where $R^1$ is alkyl or alkenyl, n is an integer of 0, and X' is COF, can be prepared by isomerization of alkyl perfluoroalkenyl ethers, as described for alkyl perfluoroisobutenyl ethers by I. L. Knunyants et al. in Izv. Akad. Nauk SSSR, Ser. Khim. (English translation) 1971(1), 93.

Starting compounds of formula I above, where $R^1$ is $R_f'CF(CH_2OH)$ and X' is hydrogen or fluorine, can be prepared by the free-radical catalyzed addition of alcohols to perfluoroolefins, as described, e.g., by J. D. LaZerte et al. in J. Am. Chem. Soc. 77, 910 (1955), by N. Ishikawa et al. in Nippon Kagaku Kaishi 1974(7), 1240, and by G. Costa et al. in J. Macromol. Sci.-Chem., A18(2), 299 (1982).

The process of the invention can be carried out by introducing, e.g., by pumping, at least one starting compound to a Simons electrochemical fluorination cell containing anhydrous hydrogen fluoride (or to which anhydrous hydrogen fluoride is simultaneously or subsequently added). The starting compound(s) and the anhydrous hydrogen fluoride can be introduced as separate streams or can be combined. The resulting mixture is then electrochemically fluorinated by the Simons process, preferably with agitation.

The Simons electrochemical fluorination cell is an electrolytic cell in which is suspended an electrode pack comprising a series of alternating and closely-spaced cathode plates (typically made of iron or nickel or nickel alloy) and anode plates (typically made of nickel). The cell body, made of carbon steel, usually is provided with a cooling jacket, a valved outlet pipe at the bottom through which can be drained the settled liquid cell product ("drainings"), a valved inlet pipe at the top of the cell for charging the cell with liquid anhydrous hydrogen fluoride and starting compound(s), and an outlet pipe at the top of the cell for removing gaseous cell products evolved in operation of the cell. The outlet pipe can be connected to a refrigerated condenser for condensing vapor comprising hydrogen fluoride, starting compound, and fluorochemicals, which can be drained back into the cell. U.S. Pat. No. 2,519,983 (Simons) contains a drawing of such a Simons electrolytic cell and its appurtenances, and a description and photographs of laboratory and pilot plant cells appear at pages 416-18 of the book *Fluorine Chemistry,* edited by J. H. Simons, Volume 1, published in 1950 by Academic Press, Inc., New York.

The Simons cell can be operated at average applied direct current cell voltages in the range of from about 4 to about 8 volts (sufficiently high, but not so high as to generate free fluorine), at current densities of from about 4 to about 20 $mA/cm^2$ (or higher) of anode surface, at substantially atmospheric or ambient pressure or higher, and at temperatures ranging from below about 0° C. to about 20° C. or as high as about 50° C.(so long as the electrolytic solution remains essentially liquid).

The initial amount of starting compound introduced to the Simons cell can be, for example, up to about 20 weight percent of the total cell contents (i.e., of the mixture of starting compound and anhydrous hydrogen fluoride), and the starting compound and the anhydrous hydrogen fluoride can be replenished from time to time. Although conductivity additives are generally not necessary, they can be utilized in the process if desired.

Other details of the Simons electrochemical fluorination process and cell will be omitted here in the interest of brevity, and the disclosures of such technology in the above-cited references to such technology can be referred to for such detail, which disclosures are incorporated herein by reference.

The process of the invention can be carried out continuously (by continuously introducing starting compound and/or anhydrous hydrogen fluoride to the cell and continuously withdrawing liquid cell product), semi-continuously (by continuously introducing starting compound and/or anhydrous hydrogen fluoride and intermittently withdrawing product, or by intermittently introducing starting compound and/or anhydrous hydrogen fluoride and continuously withdrawing product), or batchwise. The continuous mode is preferred for large-scale use of the process, as it enables better control of the operating variables and thus provides more stable cell operation.

Generally, the desired fluorochemical product of the process of the invention is preferably recovered from the crude cell product resulting from the fluorination, e.g., by condensation, phase-separation, and draining, followed by distillation. The fluorochemical product can optionally be treated with caustic to remove hydride-containing fluorochemicals.

The process of the invention enables preservation of the highly-branched structure of the starting compounds and thus makes possible the preparation of high yields of single isomers of perfluoroalkanes and perfluorocarboxylic acid fluorides having a tertiary carbon-containing structure heretofore difficult to obtain in significant yields by most electrochemical fluorination routes. The products of the process of the invention may contain small amounts of fluorinated material having one or a few residual hydrogen atoms, but are essentially fully fluorinated, i.e., perfluorinated. The perfluorocarboxylic acid fluoride products of the process are useful, for example, as precursors to fluoroalcohol acrylates, which can be used for chemical or physical incorporation into or treatment of hydrocarbon materials to impart fluorochemical properties thereto. The perfluorocarboxylic acid fluorides can also be converted to perfluorocarboxylic acids which are, as well as their salts, useful as surface active agents. The perfluoroalkane products of the process of the invention are essentially chemically inert and therefore suitable for use, e.g., as heat transfer and test-bath fluids and hydraulic fluids.

This invention is further illustrated by the following examples, but the particular materials and amounts thereof recited in these examples, as well as other conditions and details, should not be construed to unduly limit this invention.

EXAMPLES

EXAMPLE 1

Preparation of Perfluoro (2,2-dimethylpentane) ($C_3F_7C(CF_3)_2CF_3$)

A screw-cap bottle was charged with hexafluoropropene (HFP) dimer (210 g, 0.70 mole), methyl iodide (99.4 g, 0.70 mole), anhydrous KF (81.0 g, 1.40 mole), and solvent (100 g of anhydrous dimethylformamide). The bottle was sealed and agitated in a constant temperature bath at 60° C. for 24 hours. After cooling the bottle and its contents to room temperature, 100 mL of water was added to the contents to dissolve residual KF and by-product KI. The resulting organic phase was isolated, was washed with water, and was dried (using anhydrous $MgSO_4$) and distilled. The resulting product ($C_3F_7C(CF_3)_2CH_3$) was obtained as a colorless liquid (bp 86°-87° C., 110 g, yield: 47%).

The product was electrochemically fluorinated using a Simons cell of about 180 cubic centimeters capacity, made of fluoroplastic polymer, and fitted with a nickel pack of alternating anodes and cathodes and with a magnetically driven stir-bar. 30 g of $C_3F_7C(CF_3)_2CH_3$ was fed in approximately 5 g batches to the cell, and the fluorination was carried out at atmospheric pressure and ambient temperature for 15.7 hours at 7.0 volts. The current density was initially 23 mA/cm$^2$ (25 amps/ft$^2$) and dropped to less than 1.8 mA/cm$^2$ (2 amps/ft$^2$) over the course of the fluorination.

The resulting volatile products (and HF) from the cell were passed through a −40° C. condenser, where the HF and higher boiling fluorocarbon products resulting from the fluorination were condensed and the HF returned to the cell. The condensed, higher boiling fluorocarbon products were drained at periodic intervals from the condenser and separated by phase splitting to yield 25.9 g of the desired product, $C_3F_7C(CF_3)_2CF_3$. The product structure was confirmed by gas chromatography/Fourier transform infrared spectroscopy (GC/FTIR) and $^{19}F$ nuclear magnetic resonance spectroscopy (NMR).

EXAMPLE 2

Preparation of Perfluoro(4,4-dimethylheptane) ($C_3F_7C(CF_3)_2C_3F_7$)

Using essentially the procedure of Example 1, HFP dimer (30 g, 0.10 mole), allyl bromide (12.1 g, 0.10 mole), anhydrous KF (10.0 g, 0.17 mole), and solvent (30 g of anhydrous dimethylformamide) were combined and maintained at 60° C. for 16 hours, with agitation. Water (30 mL) was then added to the resulting mixture to dissolve residual KF and by-product KI. The resulting organic phase was isolated, was washed with water, and was dried (using anhydrous $MgSO_4$) and distilled. The resulting product was obtained as a colorless liquid (bp 110°-112° C., 15.0 g, yield: 42%). The structure of the product was confirmed by $^1H$ and $^{19}F$ NMR to be $C_3F_7C(CF_3)_2CH_2CH{=}CH_2$.

88.6 g of the $C_3F_7C(CF_3)_2CH_2CH{=}CH_2$ product was fluorinated essentially as in Example 1 at an average of 6.7 volts for a total of 133.7 hours. The resulting volatile products were condensed and separated essentially as in Example 1 to yield 66.5 g of the desired product, $C_3F_7C(CF_3)_2C_3F_7$. The structure of the product was determined by GC/FTIR and $^{19}F$ NMR.

EXAMPLE 3

Preparation of Perfluoro(3,3-dimethylcaproyl) Fluoride ($C_3F_7C(CF_3)_2CF_2COF$)

Using essentially the procedure of Example 1, HFP dimer (60 g, 0.20 mole), anhydrous KF (20.0 g, 0.34 mole), methyl chloroacetate (21.7 g, 0.20 mole), and solvent (30 g of anhydrous dimethylformamide) were combined and maintained at 70°-75° C. for 24 hours, with agitation. The resulting mixture was filtered, and the resulting filtrate was diluted with 100 mL of 1,1,2-trichloro-1,2,2-trifluoroethane, was washed with three 50 mL aliquots of water, and was dried (using anhydrous $MgSO_4$) and vacuum distilled to yield product boiling at 47°–48° C. at 0.5 torr. The product structure ($C_3F_7C(CF_3)_2CH_2CO_2CH_3$) was confirmed by $^1H$ and $^{19}F$ NMR.

Following essentially the procedure of Example 1, 69.5 g of $C_3F_7C(CF_3)_2CH_2CO_2CH_3$ was electrochemically fluorinated at an average of 6.6 volts for 66.4 hours. The current density averaged about 18 mA/cm$^2$ (20 amps/ft$^2$). The resulting volatile products were condensed and separated essentially as in Example 1 to yield 62.0 g of the desired product, $C_3F_7C(CF_3)_2CF_2COF$. The structure of the product was confirmed by $^{19}F$ NMR.

EXAMPLE 4

Preparation of Perfluoropivaloyl Fluoride ($(CF_3)_3CCOF$)

The starting compound, 2,2-bis(trifluoromethyl)propionyl fluoride, was prepared by heating 65.2 g of methoxyheptafluoroisobutene (which can be prepared by the reaction of perfluoroisobutene and methanol) and 0.67 g of triethylamine in a pressure vessel at 110° C. for 17 hours. The resulting crude acid fluoride was purified by distillation (bp 46°–47° C.).

2,2-Bis(trifluoromethyl)propionyl fluoride (45 g) was electrochemically fluorinated essentially as described in Example 1, over a period of 59.0 hours at an average current of 0.824 amps and an average of 6.0 volts. At the termination of the run, the coolant to the −40° C. condenser was turned off, and the entire cell system was warmed up to about 22° C. and then flushed with a mixture of $C_8$ fluorocarbons to dissolve the resulting crude solid product (mp 28° C.). Analysis of the crude product by $^{19}F$ NMR and GC/FTIR revealed the presence of the desired product, $(CF_3)_3CCOF$. A total of 21 g of the desired product was recovered from this run after distillation.

EXAMPLE 5

Preparation of Perfluoro(2,2-dimethylbutyryl) Fluoride ($C_2F_5C(CF_3)_2COF$)

Ethoxyheptafluoroisobutene was prepared by bubbling perfluoroisobutene (PFIB) (generated by pyrolysis of hexafluoropropene using the procedure in *Syntheses of Fluoroorganic Compounds,* edited by I. L. Knunyants et al., Springer-Verlag, page 9, New York (1985)) into ethanol with subsequent dehydrofluorination of the resulting mixture of 89 weight percent 2H-octafluoroisobutyl ethyl ether and 10 weight percent 1-ethoxy-1-heptafluoroisobutene (according to GC analysis). The dehyrofluorination was effected by combining 101 g of the mixture with 50 mL of a 50 weight percent solution of potassium hydroxide in water and 1.2 g of tetramethylammonium chloride and stirring the resulting combination for one hour to give 88.1 g of ethoxyheptafluoroisobutene (bp 114°–120° C.). The starting compound, 2,2-bis(trifluoromethyl)butyryl fluoride, was then prepared essentially as described in Example 4 from 70.9 g of ethoxyheptafluoroisobutene and 0.81 g of triethylamine.

The electrochemical fluorination of 41.2 g of the 2,2-bis(trifluoromethyl)butyryl fluoride was carried out by essentially the procedure described in Example 1, over a period of 57.3 hours at an average of 6.6 volts and 6.5 mA/cm$^2$ (7.0 amps/ft$^2$) current density. Upon termination of the run, the −40° C. condenser was warmed up to +30° C. to facilitate removal of the resulting crude product. Analysis of the crude product by GC/FTIR and $^{19}F$ NMR revealed the presence of the desired product, $C_2F_5C(CF_3)_2COF$. The yield of the desired product was 23 g.

EXAMPLE 6

Preparation of Perfluoro(2,4-dimethylpentanoyl) Fluoride ($(CF_3)_2CFCF_2CF(CF_3)COF$)

A mixture of perfluoro(4-methyl-2-pentene) (500 g), methanol (500 g, AR grade), and di-t-butylperoxide (6.0 g) was placed in a 2 L stainless steel reaction vessel. The resulting heterogeneous mixture was heated for 6 hours at 100°–110° C. and then cooled, and the cooled mixture was poured into an equal volume of water. The resulting lower fluorochemical phase was separated from the resulting upper aqueous phase by decantation and was dried over sodium sulfate. Distillation of the separated phase yielded 566 g of a colorless liquid (bp 36°–37° C. at 40 torr). NMR analysis of the distilled phase showed it to be a mixture of diastereomers of $(CF_3)_2CFCHFCF(CF_3)(CH_2OH)$ and $(CF_3)_2CFCF(CH_2OH)CHF(CF_3)$.

The electrochemical fluorination of the mixture was carried out in a Simons cell of about 750 cubic centimeters volume at about 70–80 kPa (about 10–12 p.s.i.g.) control and 35°–37° C. over a period of 45.6 hours. The cell was operated at an average current of 9.6 amps, with an average voltage of 5.6 volts. A total of 643 g of the mixture of diastereomers was fed to the cell in a semicontinuous manner at a rate sufficient to maintain the desired current.

A total of 610 g of product was recovered from the fluorination. GC analysis revealed the product to be 47.2% acyl fluorides of the formula $C_7F_{14}O$ (three isomers) and 39.1% acyl fluorides of the formula $C_7F_{13}HO$ (two major and two minor isomers). The yield was 60% of theoretical, based upon the amount of the mixture of diastereomers fed to the cell.

Various modifications and alterations of this invention will become apparent to those skilled in the art without departing from the scope and spirit of this invention.

We claim:

1. A process for preparing inert or functional, tertiary carbon-containing perfluorochemicals comprising the step of electrochemically fluorinating, in the presence of anhydrous hydrogen fluoride, a composition comprising at least one fluorinated starting compound which contains at least one moiety selected from the group consisting of alkyl, alkenyl hydroxyalkyl, carboxyl, halocarbonyl and alkoxycarbonyl and which also contains at least one $—CX_2—C(R_f)_2—$ group, wherein each X is independently selected from the group consisting of hydrogen, fluorine, and $CH_2OH$, and each $R_f$ group is independently perfluoroalkyl, with the proviso that when one X is $CH_2OH$, the other X is selected from the group consisting of hydrogen and fluorine.

2. The process of claim 1 wherein said starting compound contains one said $—CX_2—C(R_f)_2—$ group.

3. A process for preparing inert or functional, tertiary carbon-containing perfluorochemicals comprising the step of electrochemically fluorinating, in the presence of anhydrous hydrogen fluoride, a composition comprising at least one fluorinated starting compound represented by the general formula I:

$$R^1—C(R_f^2)(R_f^3)—(CH_2)_n—X' \quad (I)$$

wherein $R^1$ is selected from the group consisting of perfluoroalkyl groups having from 1 to about 11 carbon atoms, fluoroalkyl groups having from 1 to about 11 carbon atoms, alkyl groups having from 1 to about 3 carbon atoms, alkenyl groups having from 3 to about 6 carbon atoms, and $R_f'CF(CH_2OH)$, wherein $R_f'$ is selected from the group consisting of perfluoroalkyl groups having from 1 to about 5 carbon atoms and fluoroalkyl groups having from 1 to about 5 carbon atoms; $R_f^2$ and $R_f^3$ are independently selected from the group consisting of perfluoroalkyl groups having from 1 to about 11 carbon atoms; n is an integer of 0 to 3; and X' is selected from the group consisting of hydrogen, fluorine, COY, vinyl, and COOR, wherein Y is selected from the group consisting of the halogens and OH, and R is an alkyl group having from 1 to about 6 carbon atoms, with the proviso that when $R^1$ is alkyl, n is 0 and X' is COY, and that when $R^1$ is $R_f'CF(CH_2OH)$, X' is selected from the group consisting of hydrogen, fluorine, vinyl, and COOR.

4. The process of claim 3 wherein said $R^1$ is selected from the group consisting of methyl, ethyl, allyl, perfluoropropyl, $CF_3CF_2CF(CH_2OH)$, and $CF_3CFHCF(CH_2OH)$; said $R_f^2$ and said $R_f^3$ are both perfluoromethyl; and said X' is selected from the group consisting of hydrogen, COF, vinyl, $COOCH_3$, and $COOCH_2CH_3$.

5. The process of claim 4 wherein said compound is selected from the group consisting of $C_3F_7C(CF_3)_2CH_3$, $C_3F_7C(CF_3)_2CH_2CH{=}CH_2$, $C_3F_7C(CF_3)_2CH_2CO_2CH_3$, $CH_3C(CF_3)_2COF$, $CH_3CH_2C(CF_3)_2COF$, and $(CF_3)_2CFCF(CH_2OH)CHF(CF_3)$.

6. The process of claim 1 further comprising the step of recovering the resulting tertiary carbon-containing perfluorochemical.

7. The process of claim 1 carried out continuously.

8. A process for preparing tertiary carbon-containing, perfluorinated carboxylic acid fluorides comprising the step of electrochemically fluorinating, in the presence of anhydrous hydrogen fluoride, a composition comprising at least one starting compound selected from the group consisting of $CH_3C(CF_3)_2COF$ and $C_2H_5C(CF_3)_2COF$.

9. The process of claim 8 further comprising the step of recovering the resulting tertiary carbon-containing, perfluorinated carboxylic acid fluoride.

10. The process of claim 8 carried out continuously.

11. The process of claim 8 in which said starting compound is obtained from a raw material comprising perfluoroisobutene by a process comprising the steps of (a) allowing perfluoroisobutene to react with alkanol to form 2H-octafluoroisobutyl alkyl ether; (b) dehydrofluorinating said 2H-octafluoroisobutyl alkyl ether to form perfluoroisobutenyl alkyl ether; and (c) isomerizing said perfluoroisobutenyl alkyl ether to form said starting compound.

* * * * *